United States Patent [19]

Honegger

[11] Patent Number: 4,729,554

[45] Date of Patent: Mar. 8, 1988

[54] METHOD AND APPARATUS FOR INSERTING AT LEAST ONE INSERT INTO PREFERABLY FOLDED PRINTED PRODUCTS

[75] Inventor: Werner Honegger, Tann Rüti, Switzerland

[73] Assignee: Ferag AG, Hinwil, Switzerland

[21] Appl. No.: 12,809

[22] Filed: Feb. 9, 1987

[30] Foreign Application Priority Data

Feb. 14, 1986 [CH] Switzerland ..... 00603/86

[51] Int. Cl.[4] ..... B65H 5/30

[52] U.S. Cl. ..... 270/55; 270/57; 271/295; 271/204; 271/315

[58] Field of Search ..... 270/54–58; 271/204, 195, 196, 315

[56] References Cited

U.S. PATENT DOCUMENTS

| | | | |
|---|---|---|---|
| 3,229,599 | 1/1966 | Lowe | 271/295 |
| 3,825,246 | 7/1974 | Elia et al. | 271/295 |
| 3,951,399 | 4/1976 | Reist | 270/58 |
| 4,058,202 | 11/1977 | Reist et al. | 270/55 |
| 4,124,203 | 11/1978 | Muller | 270/55 |
| 4,133,521 | 1/1979 | Muller | 270/55 |
| 4,168,828 | 9/1979 | McLear | 270/58 |
| 4,398,170 | 8/1983 | Hansch | 270/55 |
| 4,477,067 | 10/1984 | Wise | 270/55 |
| 4,479,643 | 10/1984 | Seidel | 270/55 |

*Primary Examiner*—E. H. Eickholt

*Attorney, Agent, or Firm*—Werner W. Kleeman

[57] ABSTRACT

The printed products to be provided with inserts or supplements are infed in respective pairs by an infeed conveyor to a processing drum or cell wheel. The cell wheel comprises substantially radially extending compartments which are open at the periphery of the cell wheel. Product feed devices, for example, clamps or grippers are arranged in the compartments for forwardly advancing the printed products located in the compartments. Each compartment is divided into two feed channels by a removable divider or partition wall. These divider or partition walls terminate at a predeterminate spacing from the product feed devices. Each of the two printed products which are conjointly conveyed as a pair are infed into a respective feed channel. The printed products in the feed channels of each compartment are then conjointly advanced and approximately simultaneously opened and are furnished with an insert or supplement. This is possible, in spite of their mutual advancement, since the printed products are separated from one another by a divider or partition wall and thus do not completely repose upon one another.

24 Claims, 7 Drawing Figures

METHOD AND APPARATUS FOR INSERTING AT LEAST ONE INSERT INTO PREFERABLY FOLDED PRINTED PRODUCTS

CROSS-REFERENCE TO RELATED APPLICATION

This application is related to may commonly assigned, co-pending U.S. patent application Ser. No. 07/012,808, filed Feb. 9, 1987, and entitled "APPARATUS FOR PROCESSING PRINTED PRODUCTS".

BACKGROUND OF THE INVENTION

The present invention broadly relates to a new and improved method of, and an apparatus for, inserting or stuffing at least one insert or supplement or the like, into preferably folded printed products.

Generally speaking, the method of the present invention serves for inserting or stuffing at least one insert or supplement or the like into preferably folded printed products in which two respective printed products are conjointly advanced or fed along a processing path and in so doing are opened. Subsequently, one or more inserts or supplements are inserted between the portions or sections of the opened printed products which are separated from one another.

The apparatus of the present invention serves for inserting or stuffing at least one insert or supplement or the like into preferably folded printed products. This apparatus comprises advancing or conveying means for mutually advancing or feeding two printed products along a processing path, an opening device for opening the printed products during their advancement or feed, as well as at least one infeed device for inserting or stuffing an insert or supplement or the like between the separated portions or sections of the opened printed products.

A method and apparatus of this type is known from the Swiss patent publication No. 649,267 and the corresponding U.S. Pat. No. 4,416,448, granted Nov. 22, 1983. According to this prior art solution, in each case two printed products are simultaneously introduced into the radially extending compartments of a processing drum or cell wheel. This cell wheel is rotatably driven about its horizontal longitudinal axis.

The pairs of printed products are conjointly advanced or fed in the longitudinal direction of these compartments and are opened during this forward advancement. Both printed products conjointly repose upon one another with one of their side surfaces completely reposing upon the other during the entire forward product advance or displacement. Initially one of both of the printed products is opened while the other printed product remains closed. Subsequently, an insert or supplement is inserted into the opened printed product and now the other printed product is then opened and is then furnished with an insert or supplement.

Not only the opening of both printed products which are conjointly forwardly advanced or fed but also the insertion of the inserts or supplements into the respective opened printed product is accomplished sequentially. This requires a correspondingly long processing path, i.e. requires a correspondingly longer processing drum or cell wheel.

SUMMARY OF THE INVENTION

Therefore, with the foregoing in mind, it is a primary object of the present invention to provide a new and improved method of, and apparatus for, stuffing or inserting at least one insert or supplement into preferably folded printed products in a manner not associated with the aforementioned limitations and drawbacks of the prior art proposals.

Another and more specific object of the present invention aims at providing a new and improved method of, and apparatus for, stuffing or inserting at least one insert or supplement into preferably folded printed products in a manner affording the processing of the printed products along a processing path of minimum length, however, without the necessity of accepting a reduction of the processing capacity.

Yet a further significant object of the present invention aims at providing a new and improved construction of an apparatus for stuffing or inserting at least one insert into preferably folded printed products or the like, which apparatus is relatively simple in construction and design, extremely economical to manufacture, highly reliable in operation, not readily subject to breakdown or malfunction and requires a minimum of maintenance and servicing.

Now in order to implement these and still further objects of the invention, which will become more readily apparent as the description proceeds, the method aspects of the present development are manifested by the features that at least two printed products are at least partially held apart or separated from one another during their mutual forward advancement or feed and are substantially simultaneously opened and furnished with inserts.

As indicated heretofore, the invention is not only concerned with the aforementioned method aspects, but also pertains to an improved construction of processing or stuffing apparatus for the performance thereof. According to a preferred construction of the inventive processing or stuffing apparatus for inserting or stuffing at least one insert into the printed products, especially for inserting or stuffing at least one insert into folded printed product, the at least two printed products are at least partially separated from one another during their conjoint forward advancement or feed by means of a separating element extending in the direction of forward advancement or feed of the printed products. The opening device as well as the infeed device substantially simultaneously open the printed products and insert the inserts or supplements.

As previously indicated, both conjointly forwardly advanced or fed printed products remain at least partially separated from one another during their forward advancement or feed along the processing path. It is thus possible to open the printed products substantially simultaneously and likewise at approximately the same time to insert or furnish inserts or supplements into the opened printed products. This insertion or furnishing of inserts or supplements into the opened printed products can thus take place along a shorter processing path than if the processes of opening the printed products and the subsequent process of inserting the inserts into both printed products occur sequentially, which is the case according to the aforediscussed prior art.

The printed products and also the inserts are preferably transported in pairs to the processing path. The printed products of each pair are each simultaneously introduced or inserted into one of two adjacently positioned feed channels. The feed channels are separated over at least a portion of their height by means of a separation element, such as a divider or partition wall.

BRIEF DESCRIPTION OF THE DRAWINGS

The invention will be better understood and objects other than those set forth above will become apparent when consideration is given to the following detailed description thereof. Such description makes reference to the annexed drawings wherein throughout the various figures of the drawings there have been generally used the same reference characters to denote the same or analogous components and wherein.

DETAILED DESCRIPTION OF THE PREFERRED EMBODIMENTS

Figure 1:
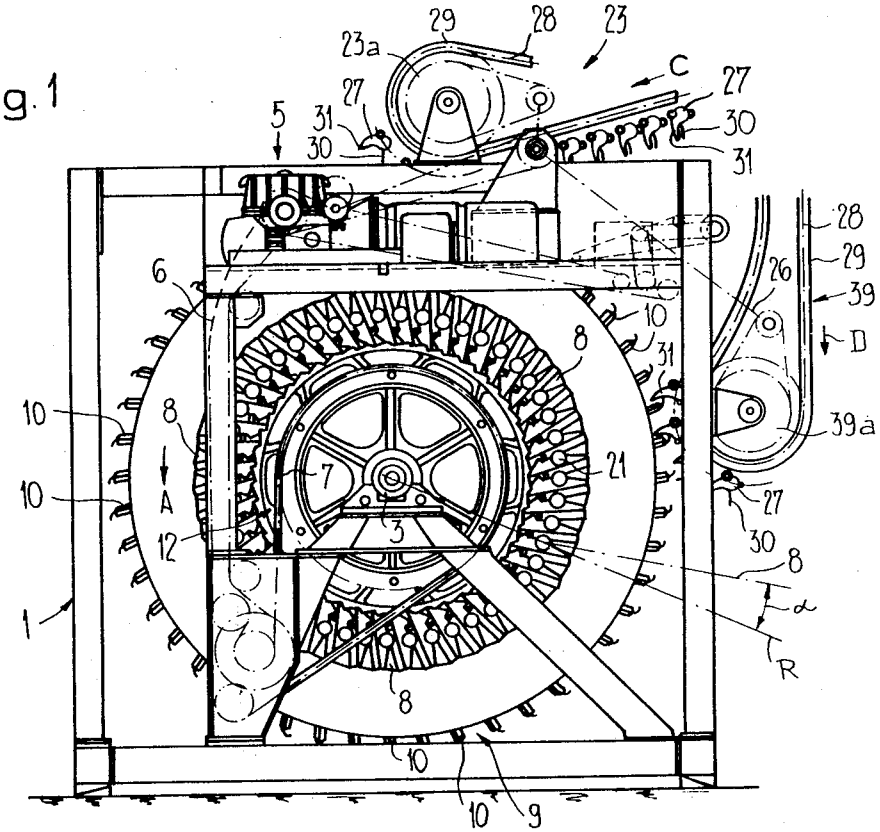
FIG. 1 is a front view of a processing apparatus in partial section and with partially removed components, containing a substantially horizontally arranged longitudinal or lengthwise axis of the processing drum or cell wheel.
Figure 2:
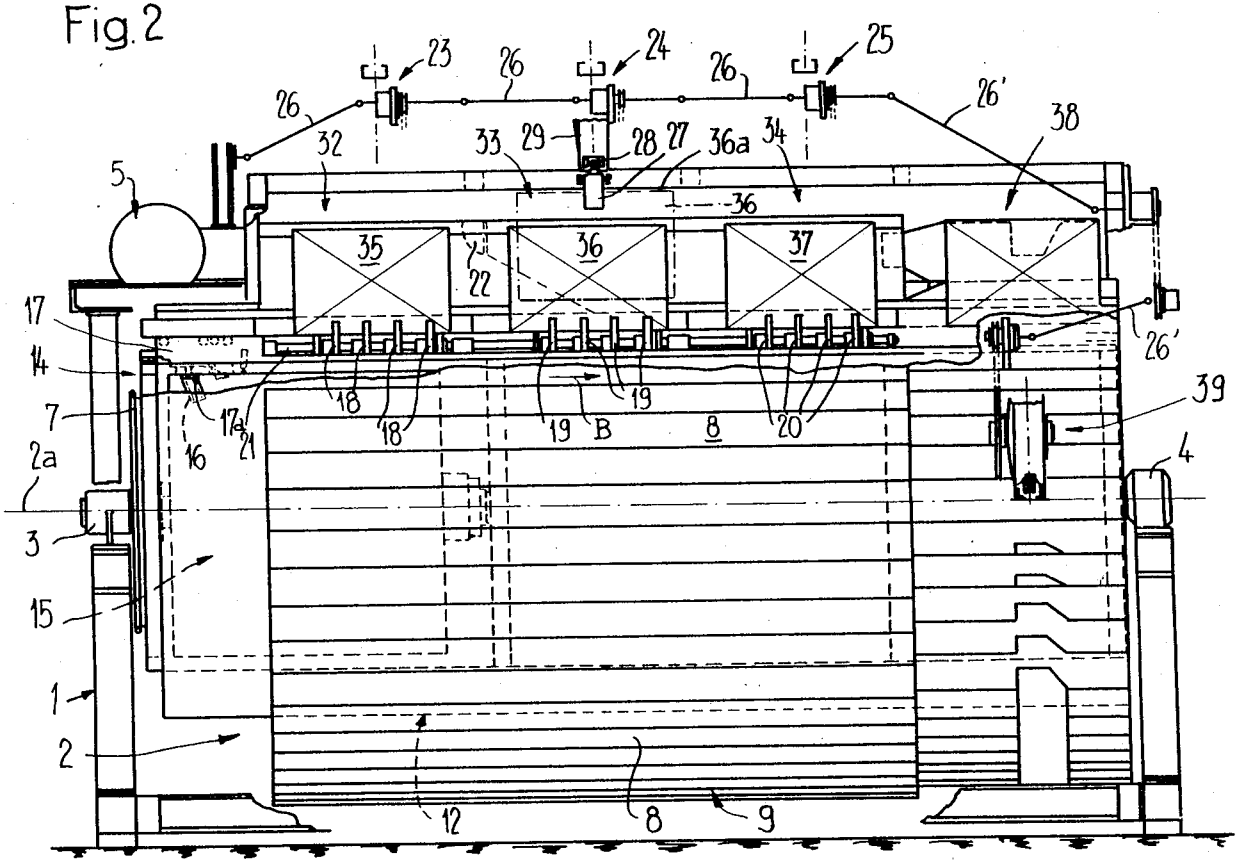
FIG. 2 is a side view in partial section and with partially removed components of the processing apparatus shown in FIG. 1.

Describing now the drawings, it is to be understood that to simplify the showing thereof only enough of the structure of the product processing apparatus for processing printed products, especially for stuffing or inserting at least one insert or supplement or the like into folded printed products or sections has been illustrated therein as is needed to enable one skilled in the art to readily understand the underlying principles and concepts of this invention. Turning now specifically to FIGS. 1 and 2 of the drawings, the product processing apparatus for printed products illustrated therein by way of example and not limitation, will be seen to comprise a processing drum or cell wheel 2 mounted in a suitable frame 1, the cell wheel 2 having a longitudinal axis 2*a* extending substantially in horizontal direction.

This processing drum or cell wheel 2 corresponds in its basic design or construction to the processing drum or cell wheel which is described in detail in German patent publication Nos. 2,447,336 and 2,604,101 and the corresponding U.S. Pat. No. 3,951,399, granted Apr. 20, 1976 and U.S. Pat. No. 4,058,202, granted Nov. 15, 1977, to which reference may be readily had and the disclosure of which is incorporated herein by reference. The above-mentioned German patent publications and U.S. patents. for this reason, can be referred to as concerns the construction and function of the processing drum or cell wheel 2.

The cell wheel 2 is rotatably mounted in two bearings or journals 3 and 4. These bearings or journals 3 and 4 are mounted at the frame 1. The frame 1 further supports a drive or drive means 5 comprising a suitable motor and transmission or gear unit. The drive or drive means 5 rotatably drives the cell wheel 2 in the direction of the arrow A by means of a conventional drive chain 6 which is thus only schematically illustrated in FIG. 1. The drive chain 6 travels over a sprocket wheel 7. This sprocket wheel 7 is operatively associated or connected with the cell wheel 2.

Figure 4:
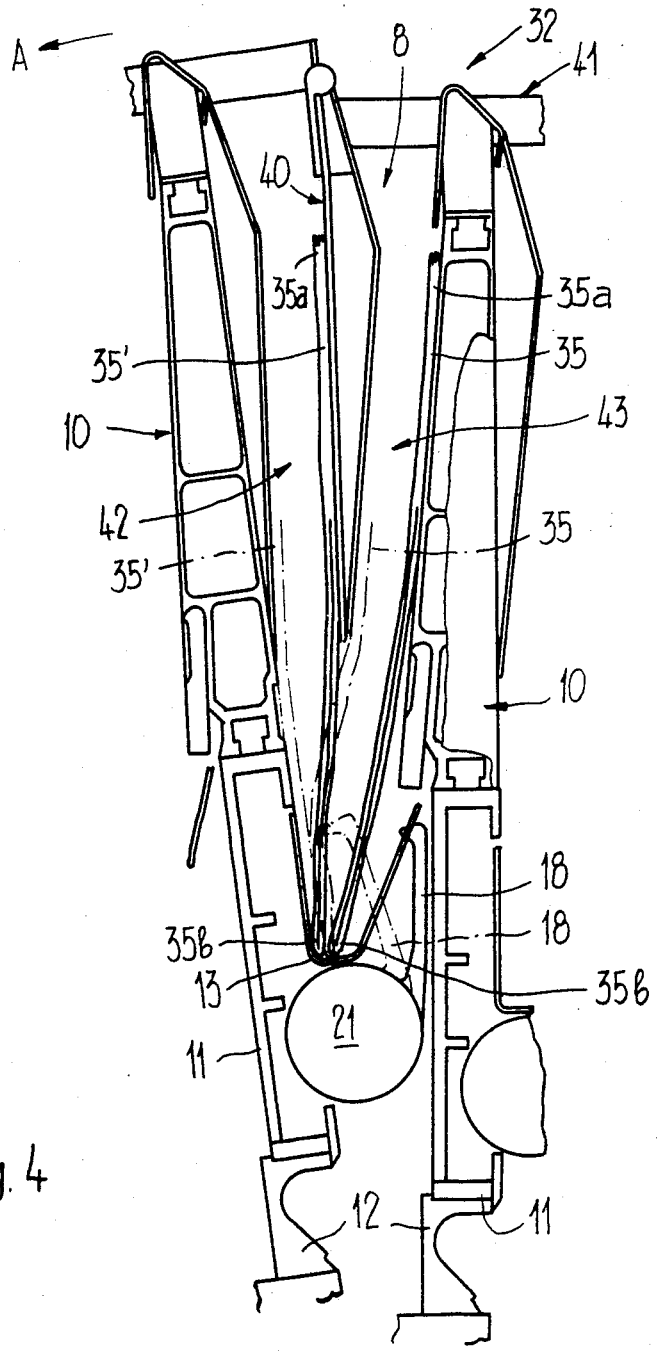
FIGS. 4, 5 and 6 are respective sections in enlarged scale of a cell or compartment of the processing drum or cell wheel at locations which are displaced from one another in the axial or lengthwise direction of the processing drum or cell wheel.
Figure 5:
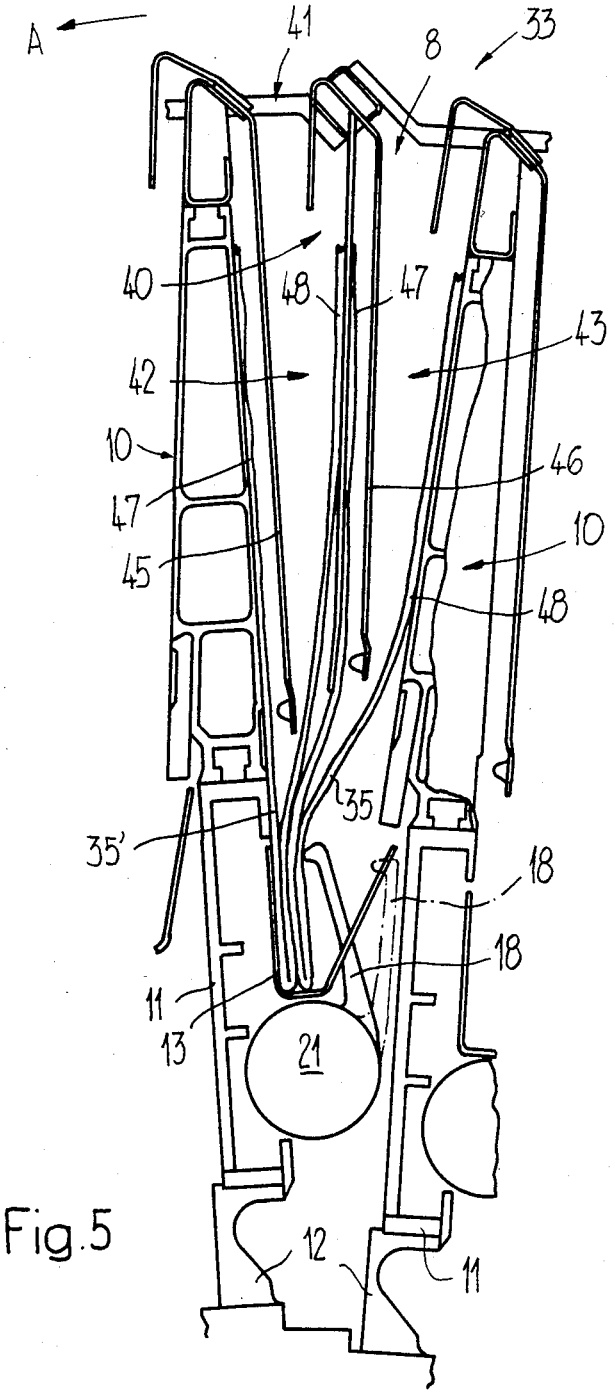
Figure 6:
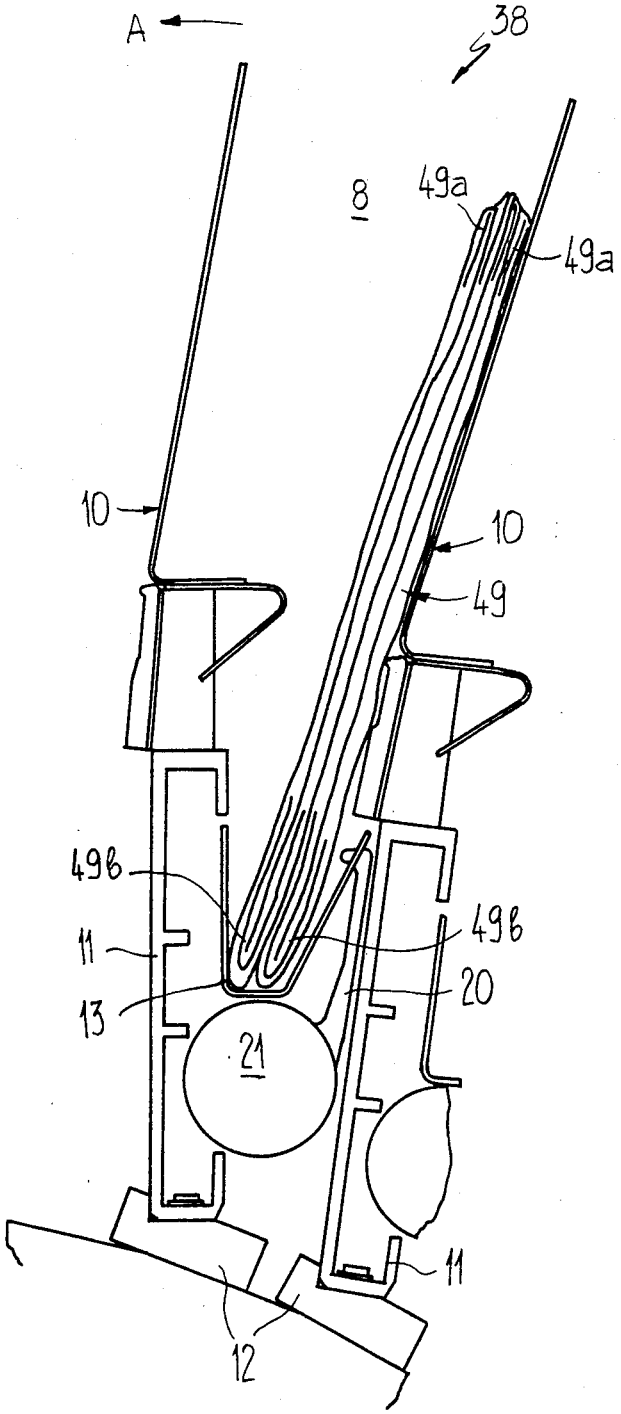

The cell wheel 2 comprises a plurality of compartments or cells 8. These compartments 8 extend radially inwardly in the direction of the longitudinal or lengthwise axis 2*a* of the cell wheel 2 and are open at the circumference or periphery 9 of the cell wheel 2. Adjacent compartments 8 are separated from one another by means of separation walls or partitions 10. These separation walls 10 are attached to substantially C-shaped or profile rails or tracks 11 (cf. FIG. 4). The substantially C-shaped profile rails 11 are connected with a base member or body 12 of the cell wheel 2, as is particularly illustrated in FIGS. 4 through 6. Not illustrated in FIGS. 4 through 6 are carriages or slides 17 (see however FIG. 2) which are displaceably guided in these substantially C-shaped profile rails 11 in the direction of the longitudinal axis 2*a* of the cell wheel 2. To these carriages or slides 17 there are connected base or floor elements 13 which close off the bottom or floor portion of the compartments 8.

A suitable product feed mechanism or device 14 is provided for each compartment or cell 8. The construction and function of this product feed device 14 is well known in this art and, for instance, is described in detail in the previously mentioned German patent publication No. 2,604,101 and the corresponding U.S. Pat. No. 4,058,202. Reference is thus likewise made to the just above-mentioned German Patent Publication and U.S. patent for details of this product feed device 14 which, however, will be considered herein to the extent needed to better appreciate the concepts and teachings of the present development.

Associated with this product feed mechanism or device 14 is a control or cam drum 15 coaxially positioned with respect to the longitudinal axis 2*a* of the cell wheel 2. This control drum 15 does not rotate and is provided at its exterior side or outer surface with a control curve or cam 16 which is only schematically illustrated in FIG. 2. Entrainment members 17*a* of the carriages or slides 17 associated with respective cell or compartment 8 engage with the control curve or cam 16. Sets of clamps or grippers 18, 19 and 20 are connected with the carriages 17 of each cell or compartment 8. These sets of clamps or grippers 18, 19 and 20 are seated on a common shaft 21. During the rotation of the cell wheel 2, the carriages 17 are forwardly advanced or fed in the direction of the longitudinal axis 2*a* of the cell wheel 2, i.e. in the direction of the arrow B and are subsequently again returned in their associated or related compartment 8 together with the sets of clamps or grippers 18, 19 and 20 as is described in detail in the previously mentioned German patent publication No. 2,604,101 and the cognate U.S. Pat. No. 4,058,202. Furthermore, the shaft 21 and the sets of clamps or grippers 18, 19 and 20 which are operatively associated or connected with this shaft 21 are pivoted.

Three product infeed or conveying devices 23, 24 and 25 are arranged above the cell wheel 2. These product infeed or conveying devices 23, 24 and 25 extend substantially parallel to one another and at a mutual spacing from one another at least in the region of the cell wheel 2. These product infeed or conveying devices 23, 24 and 25 are only schematically illustrated in FIG. 2 and correspond in their design or construction with the product infeeders or conveyors described in German patent publication No. 3,102,242 and the corresponding U.S. Pat. No. 4,381,056, granted Apr. 26, 1983, to which reference may be readily had and the disclosure of which is incorporated herein by reference. Each of these product infeed or conveying devices 23, 24 and 25 comprises individual actuatable or releasable clamping elements or grippers 27. These clamping elements or grippers 27 are attached to a chain 28 or the like which is rotatably driven in the direction of the arrow C. The chain 28 is guided in a channel 29 as is schematically illustrated in FIG. 1 with reference to the product infeed or conveying device 23. The chain 28 is guided over a deflection wheel or roller 23*a*. The product infeed or conveying devices 23, 24 and 25 are driven by the drive or drive means 5 by means of a suitable drive connection 26 which is only schematically illustrated in FIG. 2. The clamping elements or grippers 27 each comprise a movable clamping element or gripper 30, also referred to as a clamping jaw, which cooperates with a stationary clamping element or tongue or jaw 31.

Each of these product infeed or conveying devices 23, 24 and 25 defines a respective product infeed or conveyor section 32, 33 and 34. Primary printed products or main product sections 35 are transported or conveyed by means of the product infeed or conveying device 23 in a manner to be more fully described and at the related product infeed or conveying section 32 are inserted or stuffed into the individual compartments or cells 8. Both other product infeed or conveying devices 24 and 25 furnish, for instance, inserts or supplements, that is to say likewise supply printed products or secondary product sections 36 and 37 which at the respective product infeed or conveyor section 33 and 34, respectively are introduced into the previously opened primary printed products or main product sections 35 in the compartments 8.

A product removal or withdrawal section or portion 38 is located adjacent to the product infeed or conveying section 34. In the region of this product removal or withdrawal section 38 there is located a product removal transport or outfeed device 39 which is similarly constructed as the product infeed or conveying devices 23, 24 and 25 and similarly comprises clamping elements or grippers 27 having a respective movable or displaceable and a stationary clamping element or jaw 30 and 31. These clamping elements or grippers 27 are attached to a chain 28 which is guided over a deflection roll or roller 39*a*. The chain 28 is guided in a channel 29 and is rotatably driven in the direction of the arrow D. The product removal transport or outfeed device 39 is likewise driven by the drive or drive means 5 as is illustrated by means of the schematically shown drive connection 26'.

A divider or partition wall 40 projects radially inwardly into each cell or compartment 8. This divider or partition wall 40 is detachably or removably attached to the cell wheel 2 by means of a holder or support 41 (c.f. FIGS. 4 through 6). Each compartment or cell 8 thus is divided into two feed channels or passages 42 and 43 by means of these divider or partition walls 40. The divider or partition walls 40 extend only over a portion or section of the length of the cell wheel 2 and terminate before the beginning of the product removal or withdrawal section 38. In other words, the divider or partition walls 40 only extend through the product infeed or conveyor sections 32, 33 and 34. The divider or partition walls 40 do not extend to the floor or base region of the compartments 8, but end or terminate at a distance or spacing from the base or floor elements 13 as is particularly illustrated in FIGS. 4 through 6. This means that the divider or partition walls 40 do not project into the operating region of the clamps or grippers 18, 19 and 20. The feed channels 42 and 43, which are separated from one another at their outer lying regions or portions by the divider or partition walls 40, thus merge with one another at their inner lying ends in the region of the clamps or grippers 18, 19 and 20.

The mode of operation of the previously described product processing apparatus is described in the following in conjunction with FIGS. 1 through 6.

Figure 3:
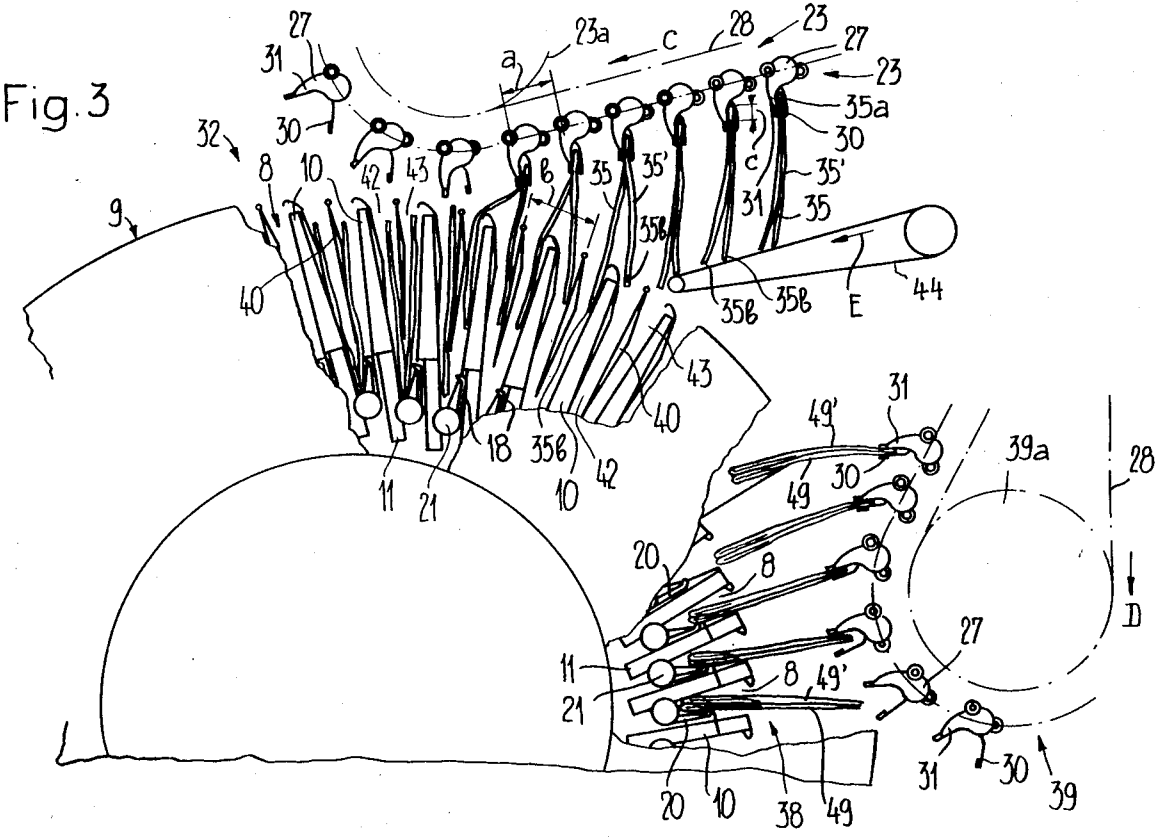
FIG. 3 is a front view in enlarged scale with respect to FIG. 1 of a portion of the processing apparatus thereof.

The distance or spacing between successive product clamps or grippers 27 of the product infeed or conveying devices 23, 24 and 25 is coordinated with the distance or spacing b of the compartments or cells 8, as shown in FIG. 3, such that during the rotation of the cell wheel 2 a respective individual compartment or cell 8 is operatively aligned with an individual clamp or gripper 27. FIG. 3 further shows that each clamp or gripper 27 of the product infeed or conveying device 23 infeeds or transports two primary or main printed products 35 and 35'. These primary printed products 35 and 35' are held in the region of their open or cut side edges which are indicated with reference numeral 35*a*.

These open or cut side edges 35*a* extend transverse to the direction of conveyance C of the product infeed or conveyor device 23. Both primary printed products 35 and 35' are also held by means of the same clamp or gripper 27 in a direction extending transverse to the previously mentioned open or cut side edge 35*a* such that they are displaced with respect to one another by a dimension or distance c so that at the oppositely situated side edge 35*b* (folded edge) one primary product 35 protrudes past the other primary printed product 35'. The cell wheel 2 is positioned before or downstream of a conveyor band or belt 44 as seen in the direction of conveyance C of the product infeed or conveying device 23 and which conveyor band or belt 44 is rotationally driven in the direction of the arrow E. The suspendedly infed primary printed products 35 and 35' come into contact at their lower or folded edges 35*b* with the conveyor belt or band 44. The primary printed products 35 and 35' are thereby stabilized in their position. After departing from the conveyor band or belt 44 both primary printed products 35 and 35', which are held in the same clamp or gripper 27, arrive at a separating wall or partition 10 which is then introduced between both primary printed products 35 and 35' as is illustrated in FIG. 3.

The introduction or inserting of the separation wall or partition 10 and thus the mutual separation of both primary printed products 35 and 35' from one another is simplified when, as already mentioned, the primary printed product 35 protrudes past the other primary printed product 35' at the lower side edge or folded edge 35*b*. The primary printed products 35 and 35' which have now been separated from one another now arrive in the respective feed channels 43 and 42 of adjacent compartments or cells 8 as is illustrated in FIG. 4. A problem-free insertion of the primary printed products 35 and 35' into the feed channels 42 and 43 is thus assured in that the compartment or cells 8 do not extend exactly in a radial direction R (cf. FIG. 1) but are forwardly inclined or sloping with respect to this radial direction R in the rotational direction A of the cell wheel 2. The central plane 8*a* of the compartments or cells 8 forms an angle $\alpha$ with the radial direction R, as can be seen in FIG. 1.

As soon as the primary printed products 35 and 35', which are conjointly conveyed or transported by means of the same clamp or gripper 27, are located in the feed channels 42 and 43, the associated gripper 27 is opened in a known and thus not here particularly illustrated manner, resulting in the release of the primary printed products 35 and 35'. This release of the primary printed products 35 and 35' results in such primary printed products 35 and 35' falling downwardly into the compartments or cells 8 until they come into contact with the base or floor element 13 with their lower side edges 35*b* as is illustrated in FIG. 4. Both primary printed products 35 and 35' which are located in the compartment or cell 8, are however, separated from one another by means of the divider or partition wall 40 as is illustrated in FIG. 4.

As a result of the further rotation of the cell wheel 2 the clamps or grippers 18 are displaced into the clamping position as is illustrated in FIG. 4 in a chain dotted line and in this clamping position clamp both primary printed products 35 and 35'. The primary printed products 35 and 35' which are engaged or gripped by means of the clamps or grippers 18 in the region of their lower side edges 35*b* are now, together with these clamps or grippers 18, displaced or forwardly advanced in the direction of the arrow B towards the product infeed section 33. The primary printed products 35 and 35' thus arrive in the operative region of product opening elements 22 which project into both infeed channels 42 and 43 of which only one opening element 22 is schematically illustrated in FIG. 2.

During the mutual forward feed or displacement of the primary printed products 35 and 35', which are located in the same cell or compartment 8, to and past the associated product opening element 22, these primary printed products 35 and 35' are simultaneously opened. Guide plates or sheets 45 and 46, for instance formed of sheet metal or plating, extend or project into each feed channel 42 and 43 downstream or behind the opening elements 22 as seen in the product transport or feed direction B. These guide plates or sheets 45 and 46 are attached to the separating wall or partition 10 of the cell or compartment 8 and to the divider or partition wall 40, respectively, and extend at a distance or spacing from these walls 10 and 40, as shown in FIG. 5. These guide plates 45 and 46 engage between both product halves or sections 47 and 48 of the opened primary printed products 35 and 35'.

When the opened primary printed products 35 and 35' are located in the second product insertion or infeed section 33, i.e. in the infeed region of the product infeed or conveying device 24, the clamps or grippers 18 are pivoted back into their open or release or inactive position illustrated in a chain dotted line in FIG. 5. These clamps or grippers 18 are again displaced back or returned to the first infeed section 32 opposite the direction of product feed or conveyance B. A return movement or displacement of the primary printed products 35 and 35' is prevented by means of not particularly illustrated return stops as is further described in the previously mentioned German patent publication No. 2,604,101 and the corresponding U.S. Pat. No. 4,058,202. In the product infeed section 33 a first insert or supplement 36 or the like is now inserted or stuffed into each opened primary printed product 35 and 35'. These inserts or supplements 36 are conveyed or transported in pairs by means of the infeed conveyor or transport device 24 in the same manner as the primary printed products 35 and 35' and are individually introduced or stuffed into the feed channels 42 and 43 as previously described with reference to FIG. 3.

The primary printed products 35 and 35' which are furnished with these inserts or supplements 36 are now held by means of the sets of clamps or grippers 19 and again conjointly forwardly advanced or fed in the direction of the arrow B to the third product infeed section 34. During the aforedescribed operation, the primary printed products 35 and 35' remain open. The sets of clamps or grippers 19 are again returned to their release or open or inactive position at this third infeed section 43 and are then displaced back or returned to the second product infeed section 33. At the third product infeed section 34 a second insert or supplement 37 or the like is now inserted or stuffed into the open primary printed products 35 and 35' which, in the same manner as the inserts or supplements 36, are fed in pairs by means of the product infeed or conveying device 25 and are individually inserted or stuffed into the feed channels 42 and 43.

The primary printed products 35 and 35', which are now furnished with both inserts or supplements 36 and 37, are now engaged by means of the sets of clamps or grippers 20 and are conjointly transported or conveyed in the direction of the arrow B into the product removal or withdrawal section 38. In this product removal or withdrawal section 38 there are no longer provided guide plates or sheets 45 and 46 and divider or partition walls 40, as can be seen from FIG. 6. The primary printed products 35 and 35' containing the inserts 36 and 37 close and come to rest or repose upon one another, that is to say become superimposed. The final or end products comprising a respective primary printed product 35 or 35' and a respective insert 36 and 37 are illustrated in FIG. 6 with reference numerals 49 and 49', respectively. In the same manner as previously described, the sets of clamps or grippers 20 rotated or pivoted into their released or opened positions are again displaced back to the product infeed section 34. Both final or end products 49 and 49' are now engaged in the region of their exterior or outer lying side edges 49*a* by means of a clamp or gripper 27 of the product removal transport or outfeed device 39 and are removed or conveyed in the direction of the arrow D as is illustrated in FIG. 3. Each clamp or gripper 27 of the product removal transport or outfeed device 39 thus engages two final or end products 49 and 49'.

The previously mentioned processing operation which has been described with respect to an individual cell or compartment 8, occurs in all other cells and compartments 8 in the same manner, however in a timewise staggered fashion.

As has already been mentioned only one transport or conveying device 14 is provided per cell or compartment 8 which is common to both of the primary printed products 35 and 35' positioned in the feed channels 42 and 43. Since the divider or partition walls 40 do not extend into the operating region of the sets of clamps or grippers 18, 19 and 20, it is thus possible to remove the divider or partition walls 40 without detrimentally affecting the functioning or operation of the cell wheel 2. This permits in a simple manner the halving of the processing capacity of the cell wheel 2 without the necessity of changing the speed of rotation of the cell wheel 2 and the conveying speed of the product infeed or conveying devices 23, 24 and 25.

Figure 7:
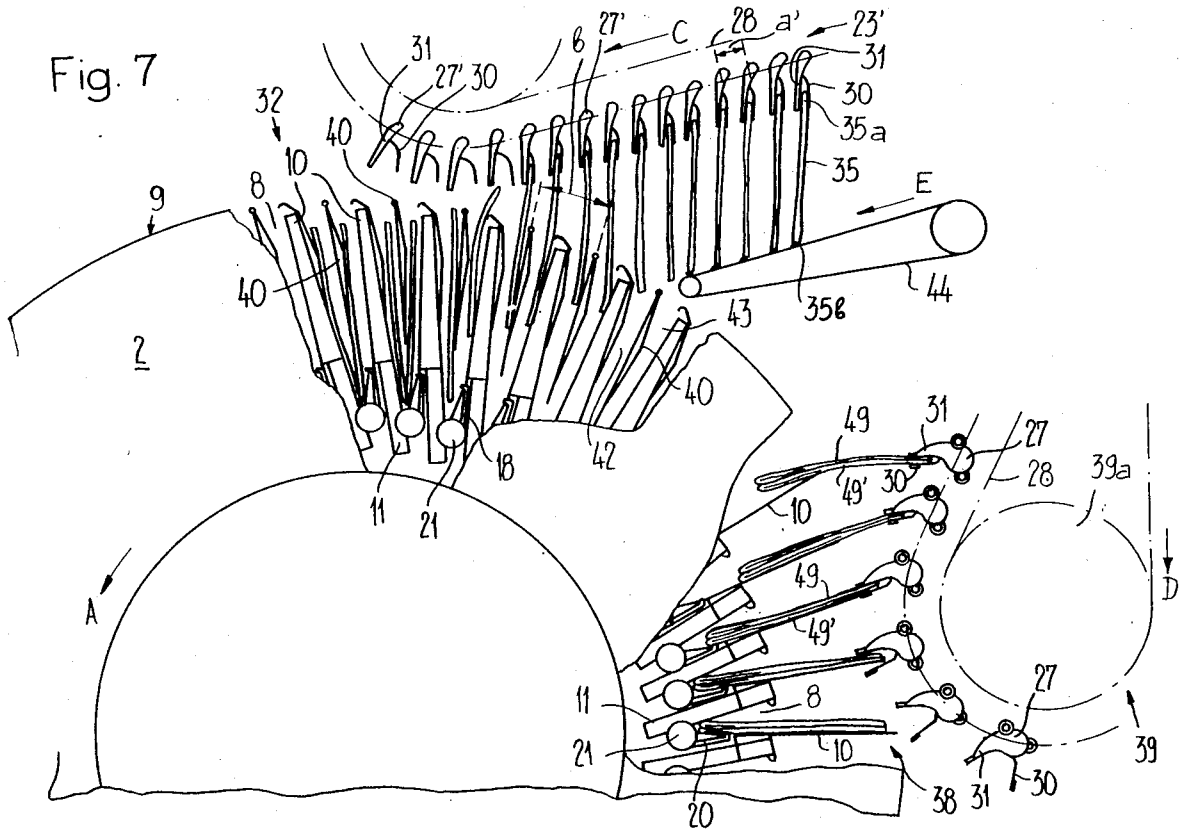
FIG. 7 is an illustration of a variant of a product processing apparatus corresponding to the illustration of the processing apparatus depicted in FIG. 3.

Another embodiment of product processing apparatus is illustrated in FIG. 7 corresponding to the illustration according to FIG. 3 which, however, differs from the embodiment according to FIG. 3 by a somewhat different design or construction of the product infeed or conveying devices 23, 24 and 25.

In the variant according to FIG. 7, the clamps or grippers 27' of the product infeed or conveying devices 23', 24' and 25' are positioned with a mutual separation or distance a' which is only approximately half as large as the distance or separation a between adjacent clamps or grippers 27 of the processing apparatus illustrated in FIG. 3. The spacing or separation i.e. pitch b of the compartments or cells 8, however, remains unchanged. Each clamp or gripper 27' now brings or transports only a single main product or primary printed product 35 or only a single insert or supplement 36 or 37, as the case may be, which is inserted or stuffed into a related feed channel 42 or 43. Also according to this embodiment, both main products or primary printed products 35 located in the feed channels 42 and 43 of a cell or compartment 8 are conjointly advanced or transported, approximately simultaneously opened and furnished with inserts or supplements, as has previously been described in detail.

According to the illustrated embodiments, it is possible to process the primary printed products individually with respect to one another, even though conjointly forwardly advanced or fed, since they do not completely rest or repose with their full surfaces upon one another but are separated from one another by means of the separation partition walls 40. This allows that the primary printed products 35 and 35' can undergo substantially simultaneously the same processing steps such as opening and stuffing or inserting of the inserts or the supplements 36 and 37. This means that the processing path required for stuffing or inserting the inserts can be correspondingly short.

Rather than insert or stuff, as is shown in FIG. 3, both primary printed products 35 and 35' which are conjointly infed by means of the product infeed or conveying device 23 into the feed channels 42 and 43 of adjacent cells or compartments 8, it is also possible to insert or stuff the primary printed products 35 and 35' into the respective feed channels 42 and 43 of the same cell or compartment 8. In such a case rather than the separation or partition wall 10 of the cell or compartment 8 being inserted or introduced between the printed products 35 and 35' the corresponding divider or partition wall 40 would be inserted or introduced between both primary printed products 35 and 35' which are held by means of the same clamp or gripper 27.

It is understood that in lieu of the cell wheel or processing drum 2, other processing apparatuses also can be utilized in which the primary printed products 35 and 35' travel or advance through a substantially linear processing path or through a different type of a two dimensional processing path.

While there are shown and described present preferred embodiments of the invention, it is to be distinctly understood that the invention is not limited thereto, but may be otherwise variously embodied and practiced within the scope of the following claims.

Accordingly, What I claim is

1. A method of inserting at least one insert into printed products, comprising the steps of:

conjointly moving two printed products along a processing path while maintaining two printed products at least partially in non-contacting relationship;

during the conjoint movement of said two printed products along said processing path essentially simultaneously opening said printed products; and inserting at least one insert into each said opened printed product.

2. A method of inserting at least one insert into printed products, especially folded printed products, comprising the steps of:

conjointly moving two printed products along a processing path;

the step of conjointly moving said two printed products along said processing path entails maintaining said two printed products at least partially in spaced relationship from one another;

during the conjoint movement of said two printed products along said processing path essentially simultaneously opening said two printed products; and inserting at least one insert into each said opened printed product.

3. The method as defined in claim 2, wherein the printed products constitute folded printed products each having a folded edge and a side edge situated opposite said folded edge, wherein:

said step of maintaining said two printed products at least partially in spaced relationship from one another entails separating from one another the folded printed products at the region of the side edge situated opposite the folded edge of each said two folded printed products.

4. The method as defined in claim 3, wherein:

said step of conjointly moving the two printed products entails advancing the two printed products essentially in the direction of their folded edges.

5. The method as defined in claim 3, wherein:

the step of conjointly moving the two printed products entails engaging and forwardly advancing the two printed products by common product feed means engaging at the region of predeterminate side edges of the two printed products.

6. The method as defined in claim 3, wherein:

the step of conjointly moving the two printed products entails engaging and forwardly advancing the two printed products by common product feed means engaging at the region of predeterminate side edges of the two printed products; and said predeterminate side edges of the two printed products engaged by said common product feed means are the folded edges of said two printed products.

7. The method as defined in claim 2, wherein:

said step of conjointly moving the two printed products along the processing path entails moving each of said two printed products while located adjacent one another in a predeterminate direction of feed through feed channels which are at least partially separated from one another.

8. The method as defined in claim 5, further including the steps of:

infeeding the two printed products approximately simultaneously into two feed channels prior to conjointly moving said two printed products along said processing path.

9. An apparatus for inserting at least one insert into printed products, comprising:

feed means for conjointly advancing two printed products along a processing path in a predetermined direction of feed;

a separating element extending in the predetermined direction of feed of the two printed products for at least partially separating from one another said two printed products during such time as said two printed products are conjointly advanced along the processing path;

opening means for opening the two printed products during such time as the two printed products are conjointly advanced along the processing path so as to form at each opened printed product separated product portions;

at least one infeed means for introducing a respective insert between the separated portions of each opened printed product of said two printed products;

said opening means serving for approximately simultaneously opening the two printed products; and said at least one infeed means serving for approximately simultaneously inserting a respective insert into the separated portions of each opened printed product of said two printed products.

10. The apparatus as defined in claim 9, wherein:

said at least one infeed means serves to simultaneously infeed and introduce the respective inserts into the separated portions of each of said opened printed products.

11. The apparatus as defined in claim 9, wherein said printed products comprise folded printed products each having a folded edge and a side edge situated opposite said folded edge, wherein:

said feed means comprise common feed means engaging said two printed products at the region of a respective side edge thereof which extends in said predetermined direction of feed of the two printed products.

12. The apparatus as defined in claim 11, wherein:

said common feed means engage said two printed products at the region of the respective folded edge thereof.

13. The apparatus as defined in claim 9, wherein:

said at least one infeed means comprises infeed means for simultaneously infeeding two printed products in pairs at predeterminate intervals to the processing path.

14. The apparatus as defined in claim 13, wherein:

said infeed means for simultaneously infeeding two printed products in pairs at predeterminate intervals to the processing path comprising individually actuatable grippers each of which engage two of said printed products at a respective side edge thereof and retain said two printed products in a position which is mutually offset transversely to each said side edge.

15. The apparatus as defined in claim 14, wherein:

said infeed means for simultaneously infeeding two printed products in pairs at predeterminate intervals to the processing path having a predetermined direction of conveying of the printed products; and said individually actuatable grippers engage said two printed products at a respective side edge thereof extending transversely to said predetermined direction of conveying of the printed products.

16. The apparatus as defined in claim 14, wherein:

said infeed means for the printed products infeeding said printed products in pairs in a suspended state with a leading printed product of said pair of said two printed products protruding past an other one of the printed products of said pair which defines a trailing printed product.

17. The apparatus as defined in claim 9, further including:

a processing drum having a substantially horizontally extending longitudinal axis and a periphery;

means for rotatably driving said processing drum for rotation about said substantially horizontally extending longitudinal axis;

said processing drum being provided with a plurality of compartments extending in the direction of said substantially horizontally extending longitudinal axis;

each of said compartments being open at the periphery of said processing drum and having a predetermined direction of extent;

said feed means comprising feed structure provided for each compartment and effective in the direction of extent of each said compartment for conjointly forwardly advancing two printed products in the direction of the substantially horizontally extending axis of the processing drum; and a respective one said separation element being provided for each compartment for subdividing each compartment into two feed channels, each of which feed channels serves to receive a respective one of said two printed products.

18. The apparatus as defined in claim 17, wherein:

the separation element for each compartment protrudes into said compartment to an extent such that it is located externally of an effective region of the feed structure of the related compartment.

19. The apparatus as defined in claim 18, wherein:

each compartment has means defining a floor;

each separation element comprises a divider wall which protrudes from the region of the periphery of the processing drum into the associated compartment and terminates in spaced relationship from the floor of such compartment; and said feed structure of each compartment being effective at the region of the floor of such compartment at the two printed products located in such compartment.

20. The apparatus as defined in claim 17, wherein:

each said compartment extends radially at an inclination with respect to a predeterminate radial direction of the rotatably driven processing drum and forwardly with respect to the direction of rotation of the rotatably driven processing drum.

21. The apparatus as defined in claim 17, further including:

means for removably mounting the separation elements at the rotatably driven processing drum.

22. The apparatus as defined in claim 17, wherein:

said at least one infeed means comprises infeed means for simultaneously infeeding two printed products in pairs at predeterminate intervals to the processing path;

said infeed means being arranged above the rotatably driven processing drum and possessing a conveying direction for the printed products which extends transversely to the substantially horizontally extending longitudinal axis of the processing drum; and said infeed means conjointly infeeding said two printed products in pairs and introducing respective ones of said two conjointly infed printed products into respective ones of said feed channels.

23. The apparatus as defined in claim 22, wherein:

said infeed means for simultaneously infeeding two printed products in pairs at predeterminate intervals to the processing path comprising individually actuatable grippers each of which engage two of said printed products at a respective side edge thereof and retain said two printed products in a position which is mutually offset transversely to each said side edge;

a band conveyor arranged below the at least one infeed means;

said band conveyor being disposed forwardly of the rotatably driven processing drum viewed with respect to the conveying direction of said infeed means; and the printed products retained by the grippers coming to bear at lower side edges thereof upon said band conveyor and which lower side edges are disposed opposite said side edges engaged by said individually actuatable grippers.

24. An apparatus for inserting at least one insert into printed products, comprising:

means for advancing pairs of printed products along a processing path in a predetermined direction of feed;

a separating element extending in the predetermined direction of feed of the pairs of printed products for placing each pair of printed products into at least partially non-contacting relationship during such time as said pairs of printed products are advanced along the processing path;

opening means for opening each pair of printed products during such time as the pair of printed products are advanced along the processing path so as to form at each opened printed product of the pair separated product portions;

infeed means for introducing a respective insert between the separated portions of each opened printed product of each said pair of printed products;

said opening means serving for approximately simultaneously opening the two printed products; and said infeed means serving for inserting a respective insert into the separated portions of each opened printed product of said pair of printed products.

* * * * *